United States Patent [19]

DaFonte, Jr. et al.

[11] 4,252,619

[45] Feb. 24, 1981

[54] BRIGHTENER FOR ZINC ELECTROPLATING SOLUTIONS AND PROCESS

[75] Inventors: Bento DaFonte, Jr., Carson City, Nev.; Sylvia Martin, Detroit, Mich.

[73] Assignee: Oxy Metal Industries Corporation, Warren, Mich.

[21] Appl. No.: 87,909

[22] Filed: Oct. 24, 1979

[51] Int. Cl.[3] ..... C25D 3/22

[52] U.S. Cl. ..... 204/55 R; 204/55 Y

[58] Field of Search ..... 204/55 R, 55 Y, 114

[56] References Cited

U.S. PATENT DOCUMENTS

| | | | |
|---|---|---|---|
| 2,389,135 | 11/1945 | Brown | 204/55 R X |
| 2,389,179 | 11/1945 | Brown | 204/55 R X |
| 2,389,180 | 11/1945 | Brown | 204/55 R X |
| 4,176,017 | 11/1979 | Martin | 204/55 R |

*Primary Examiner*—G. L. Kaplan

*Attorney, Agent, or Firm*—Richard P. Mueller

[57] ABSTRACT

An aqueous acidic or alkaline zinc electroplating solution and process for producing a bright, adherent and ductile zinc deposit on conductive substrates incorporating a primary brightening agent comprising a compound or mixture of compounds represented by the structural formulae:

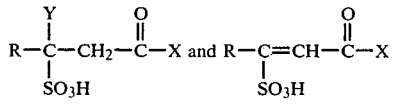

The brightening agent is present in a controlled effective amount to provide a brightening and ductilizing of the deposited zinc plating. The electroplating solution further can incorporate conventional constituents and supplemental additives of the types well known in the art.

13 Claims, No Drawings

BRIGHTENER FOR ZINC ELECTROPLATING SOLUTIONS AND PROCESS

BACKGROUND OF THE INVENTION

The present invention broadly relates to aqueous acidic or alkaline zinc electroplating solutions and a process employing such solutions for depositing a corrosion resistant and decorative zinc electroplating on a variety of substrates, such as, ferrous articles such as iron and steel. A variety of such zinc electroplating solutions have heretofore been proposed or commercially used incorporating various additive agents for enhancing the brightness, ductility, adherence and/or leveling of the electrodeposit. Conventionally, such additive agents are employed in admixture whereby each of the plurality of brightening agents contributes toward the desired end result.

The present invention provides for an improved aqueous zinc electroplating solution which overcomes some of the problems and disadvantages associated with prior art type formulations incorporating a primary brightening agent which is effective to provide for bright, ductile and adherent zinc electroplatings and which is of versatile use in both acidic chloride and sulfate type zinc electroplating solutions as well as in alkaline-type cyanide and non-cyanide zinc electroplating solutions. The improved aqueous zinc electroplating bath is suitable for use over a broad pH operating range as well as over a broad range of current densities.

SUMMARY OF THE INVENTION

The benefits and advantages of the present invention are achieved by an aqueous zinc electroplating solution containing zinc ions and an effective amount sufficient to provide a bright, adherent and ductile zinc electrodeposit on a conductive substrate of a bath soluble brightening agent and mixtures of brightening agents represented by the structural formulae:

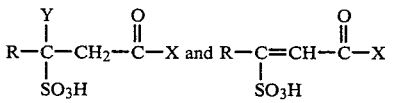

Wherein:

- R is H or $C_6$–$C_{10}$ aryl, or $C_6$–$C_{20}$ alkyl aryl in which the alkyl group is $C_1$–$C_4$; or $C_1$–$C_{22}$ alkyl, or $C_2$–$C_{10}$ heterocyclic nitrogen compounds having at least one tertiary or quaternary ring containing nitrogen; as well as the mono, di or tri substituted derivatives thereof including —OH, —$SO_3H$ or —COOH; the Group I and II and $NH_4$ salts thereof; and the aldehyde, ketone and ether derivatives thereof;
- X is R or —OR′ or —$NR_2$′ in which R′ is H or a $C_1$–$C_4$ aliphatic radical; and
- Y is H or $SO_3H$ as well as the compatible bath soluble salts thereof.

The bath soluble salts of the brightener agent usually comprise the Group IA and IIA metals as well as ammonia.

The primary brightening agent can be employed in amounts of about 0.001 up to about 10 g/l with amounts of about 0.01 to about 5 g/l being preferred. In addition to the primary brightening agent, the electroplating solution can further contain one or a plurality of supplemental or secondary brightening agents of the various types well known in the art and which are suitable for use in the specific acid chloride, acid sulfate or alkaline zinc plating solution.

In accordance with the process aspects of the present invention, bright, ductile and adherent zinc electroplatings are deposited on conductive substrates employing the aforementioned aqueous zinc electroplating solution which is controlled at a temperature of from about 60° up to about 180° F. and which can be operated at current densities ranging from about 1 up to about 300 amperes per square foot (ASF) depending upon the specific type and composition of the electroplating solution.

Additional benefits and advantages of the present invention will become apparent upon a reading of the description of the preferred embodiments taken in conjunction with the specific examples provided.

DESCRIPTION OF THE PREFERRED EMBODIMENTS

The improved aqueous zinc electroplating solution of the present invention incorporates as a primary brightening agent, a compound represented by the structural formulae:

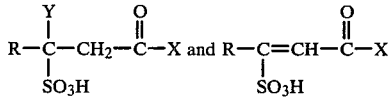

Wherein:

- R is H or $C_6$–$C_{10}$ aryl, or $C_6$–$C_{20}$ alkyl aryl in which the alkyl group is $C_1$–$C_4$; or $C_1$–$C_{22}$ alkyl, or $C_2$–$C_{10}$ heterocyclic nitrogen compounds having at least one tertiary or quaternary ring containing nitrogen; as well as the mono, di or tri substituted derivatives thereof including —OH, —$SO_3H$ or —COOH; the Group I and II and $NH_4$ salts thereof; and the aldehyde, ketone and ether derivatives thereof;
- X is R or —OR′ or —$NR_2$′ in which R′ is H or a $C_1$–$C_4$ aliphatic radical; and
- Y is H or $SO_3H$ as well as the compatible bath soluble salts thereof.

Typical of the compounds which can be employed as a primary brightening agent in accordance with the foregoing structural formulae are those as set forth in Table 1.

TABLE 1

3-sulfopropanal, sodium salt
4-phenyl-4-sulfobutan-2-one, sodium salt
4-phenyl-4-sulfobuten-2-one, sodium salt
4-phenyl-4,4-disulfobutan-2-one, disodium salt
4-sulfo-4-(3,4-dimethoxyphenyl) butan-2-one, sodium salt
4-(3,4-methylenedioxyphenyl)-4-sulfobutan-2-one, sodium salt
3-sulfo-3-phenylpropanal, sodium salt
3-sulfo-3-phenylpropanoic acid, monosodium salt
1,3-diphenyl-3-sulfopropan-1-one, sodium salt
3-sulfobutanal, sodium salt
3-(2-furyl)-3-sulfopropanal, sodium salt
3-(3-indolyl)-3-sulfopropanoic acid, monosodium salt
3-(5-bicyclo [2.2.1] heptene)-3-sulfopropanoic acid, monosodium salt
4-sulfobutan-2-one, sodium salt 3,3-diphenyl-3-sulfopropanal, sodium salt
3-phenyl-3-sulfopropenal, sodium salt
3-phenyl-3,3-disulfopropanal, disodium salt
1-(4-piperidyl)-3-sulfo-5-(3,4-methylenedioxyphenyl)-4-penten-1-one, sodium salt
1-(4-piperidyl)-5-sulfo-5-(3,4-methylenedioxyphenyl)-2penten-1-one, sodium salt
1-(4-piperidyl)-3,5-disulfo-5-(3,4-methylenedioxyphenyl)-1-pentanone, disodium salt
3-(3-pyridyl)-3-sulfopropanoic acid, monosodium salt
3-(4-imidazyl)-3-sulfopropanoic acid, monosodium salt
4-phenyl-2-sulfo-4-oxobutanoic acid, monosidium salt
4-phenyl-3-sulfo-4-oxobutanoic acid, monosodium salt
1,7-di-(3-methoxy-4-hydroxylphenyl)-7-sulfo-1-hepten-3,5-dione, sodium salt
1,7-di-(3-methoxy-4-hydroxyphenyl)-1,7-disulfohepta-3,5-dione, disodium salt
4-(2-furyl)-4-sulfobutan-2-one, sodium salt
4-phenyl-4-sulfobuten-2-one, sodium salt
4-phenyl-4,4-disulfobutan-2-one, disodium salt
3-phenyl-3-sulfopropenal, sodium salt
3-phenyl-3,3-disulfopropanal, disodium salt
4-sulfobuten-2-one, sodium salt
4,4-disulfobutan-2-one, disodium salt The brightener agents of the present invention may be conveniently prepared by reacting substantially equal molar quantities of an $\alpha$, $\beta$ unsaturated carboxyl compound with an alkali metal or ammonium bisulfite or meta bisulfite in an aqueous or aqueous organic solvent medium at temperatures up to reflux for a period of time to effect substantially complete reaction. The reaction product may be isolated by crystallization from the reaction medium and may be further purified by recrystallization.

For example, 4-phenyl-4-sulfobutan-2-one, sodium salt can be prepared in accordance with the following procedure:

To a solution of 26.15 g (0.25 mol) of sodium meta bisulfite in 50 ml $H_2O$ heated to 45° C., was added 40.2 g (0.275 mol) of liquified benzal acetone. The solution was stirred and heated to reflux (105° C.) at which point the reaction became exothermic. The heat was removed and the reflux sustained itself for 5–10 minutes after which the reaction mixture was clear and only one layer was apparent. The reaction mixture was cooled slowly and a small amount of ether was added for extraction. Since the solution began solidifying, 175 ml water was added and then the water reduced in volume slowly until crystallization just began. Recrystallization from acetone and drying in a heated (70° C.) vacuum dessicator gave the 45 g of 4-phenyl-4-sulfobutan-2-one, sodium salt (73% yield).

In accordance with the composition aspects of the present invention, the primary brightening agent such as the compounds listed in Table 1 or mixtures thereof can be employed in the aqueous zinc electroplating solution in controlled effective amounts so as to produce a bright, ductile and adherent zinc deposit. Generally, amounts ranging from about 0.001 up to about 10 g/l can be employed while amounts of about 0.01 to about 5 g/l are usually preferred.

The primary brightening agent can be employed in aqueous acidic zinc chloride electroplating solutions, aqueous acidic zinc sulfate electroplating solutions as well as in aqueous alkaline cyanide and non-cyanide zinc electroplating solutions. The primary brightening agent is particularly applicable to non-cyanide type electroplating solutions. The concentration of zinc ions in such solutions may broadly range from about 5 g/l up to saturation in the solution at the particular operating bath temperature, for example, 300 g/l and higher at bath temperature of 100° F. and above. Typically, in acid chloride solutions, the zinc ion concentration is conventionally controlled within a range of from about 7 up to about 50 g/l. In acid sulfate electroplating solutions, the zinc ion concentration is usually controlled within a range of about 30 up to about 110 g/l while in aqueous alkaline non-cyanide zinc solutions, the zinc ion concentration is usually controlled within a range of about 5 up to about 25 g/l. It will be apparent from the foregoing, that the zinc ion concentration for the several non-cyanide electroplating solutions can broadly be employed in an amount ranging from about 5 up to saturation, and preferably from about 5 g/l to about 110 g/l.

In the acid chloride-type electroplating solutions, it is conventional to further include inert salts to increase the conductivity of the solution which can usually be employed in amounts of about 20 up to about 450 g/l. Such inert salts conveniently comprise alkali metal chlorides in which the term "alkali metal" is employed in its broad sense to also include ammonium chloride as well as the specific alkali metals such as sodium, potassium, and lithium.

It is also conventional practice to employ suitable buffering agents in the acid chloride and acid sulfate-type electroplating solutions. Typically, boric acid can be employed for this purpose and is used in amounts ranging from about 1 up to about 40 g/l. In the acid-type plating baths, the pH may range from about 1.0 to about 6.5. In the acid chloride electroplating solution, the hydrogen ion concentration is usually controlled so as to provide a bath operating pH of about 4.5 up to about 6.2 while in the acid sulfate electroplating solution, the hydrogen ion concentration of the operating bath is preferably controlled within a pH of about 3.5 up to about 5.2. In the alkaline cyanide and non-cyanide type electroplating baths, the pH is above about 8.0. In non-cyanide type baths, suitable alkali metal hydroxides such as sodium hydroxide or potassium hydroxide are employed to impart conductivity to the bath and to further provide a hydroxyl ion concentration to achieve a bath operating pH usually above about 12.

In addition to the zinc ions and primary brightening agent, the aqueous zinc electroplating solution may further contain supplemental or secondary brightening agents of the types conventionally employed in acid chloride, acid sulfate and alkaline cyanide and non-cyanide zinc electroplating solutions. Such supplemental brightening agents may be of any of the types well known in the art and are usually employed in amounts up to about 10 g/l while amounts of about 0.2 up to about 5 g/l are usually preferred. Typical of such secondary or supporting brightening agents that can be conventionally used in acid zinc chloride electroplating solutions are polyethers, aromatic carboxylic acids and their salts, nicotinate quaternary compounds, or the like. For alkaline zinc electroplating solutions, typical supporting brighteners may be of the class including polyamine and polyethyleneimine quaternaries, aromatic aldehydes, polyvinyl alcohols, and the like. For acidic zinc sulfate electroplating solutions, typical supporting brighteners include polyacrylamides, thioureas, nicotinate quaternaries, and the like. Such supporting brighteners are usually employed in the form of a mixture of two or more in combination with the primary brightening agent of the improved zinc plating bath of the present invention.

In accordance with the process aspects of the present invention, the aqueous zinc electroplating solution incorporating the primary brightener can be operated at about room temperature (60° F.) up to about 120° F. while temperatures ranging from about 65° to about 90° F. are more typical. The current density at which such solutions can be operated vary depending upon the specific type of bath. For example, alkaline zinc and acid chloride electroplating solutions can be operated at current densities of about 1 up to about 80 ASF while acid sulfate baths can be operated at current densities of about 20 up to about 300 ASF. The specific current density employed will vary depending upon the plating technique used, the type of article being plated and the specific operating bath composition and concentration.

In order to further illustrate the improved aqueous zinc plating solution of the present invention, the following specific examples are provided. It will be appreciated that the examples provided are for illustrative purposes and are not intended to be restrictive of the present invention as herein described and as set forth in the subjoined claims.

EXAMPLE I

An acid chloride-type zinc electroplating solution is prepared containing about 30 g/l zinc ions, a total chloride ion content of about 300 g/l, boric acid in an amount of about 27 g/l, 0.5 g/l of a carrier or supporting brightener comprising acetylenic glycol 2, 3, 7, 9-tetra methyl 5-decyne-4, 7 diolethoxylated (commercially available under the brand name Surfynol 485 from AIRCO) and 0.3 g/l of the primary brightener 3-sulfopropanal, sodium salt. In accordance with the foregoing structural formulae, this primary brightener corresponds to a compound in which R is H, X is H and Y is H.

Parts plated in this solution at a cathodic current density of about 40 ASF exhibited good overall brightness of the ductile and adherent zinc electrodeposit.

EXAMPLE II

An acid chloride-type zinc electroplating solution is prepared containing 25 g/l zinc ions, a total chloride ion content of 280 g/l, 27 g/l boric acid, 3 g/l of benzoic acid as a supporting carrier brightener, 0.4 g/l of a supporting brightener Surfynol 485 as employed in Example I and as the primary brightener, 4-phenyl-4-sulfobutan-2-one, sodium salt in a concentration of 0.05 g/l. The primary brightener corresponds to the foregoing structural formulae in which R is a phenyl group, X is a methyl group, and Y is H.

Parts plated in this electroplating solution at a cathodic current density of 50 ASF exhibited good overall brightness of the ductile and adherent zinc electrodeposit.

EXAMPLE III

An acid chloride-type zinc electroplating solution is prepared containing 35 g/l zinc ions, 320 g/l total chloride ions, 27 g/l boric acid, 2 g/l of salicyclic acid as a supplemental carrier brightener, 0.25 g/l of ethoxylated $\beta$-naphathol as a supporting carrier brightener and 0.06 g/l of 3-sulfo-3-phenylpropanal, sodium salt as the primary brightener. The bath is at a pH of about 5.5.

The primary brightener corresponds to the foregoing structural formulae in which R is phenyl, X is H and Y is H.

Parts plated in this electroplating solution at a cathodic current density of 30 ASF exhibited good overall brightness of the adherent and ductile zinc electrodeposit.

EXAMPLE IV

An alkaline zinc electroplating solution is prepared containing 8 g/l zinc ions, 80 g/l sodium hydroxide, 1 g/l of polyethyleneimine quaternary as a supporting carrier brightener and 0.5 g/l of 4-sulfo-4-(3,4-dimethoxyphenyl) butan-2-one, sodium salt as the primary brightener. This primary brightener corresponds to the structural formulae in which R comprises a substituted phenyl group with two ether groups, X is a methyl group and Y is H.

The bath pH is 14. A Hull Cell panel plated in this solution at a current density of 1 ampere current exhibited good brightness at current densities below about 50–60 ASF.

EXAMPLE V

An acid sulfate-type zinc electroplating solution is prepared containing 180 g/l zinc sulfate monohydrate, 30 g/l boric acid, 15 g/l ammonium sulfate, and 0.5 g/l 4-phenyl-4-sulfobutan-2-one, sodium salt as the primary brightener. The electroplating solution had a pH of about 4.2.

Test panels plated in this solution at a current density of from about 20 to about 90 ASF exhibited very good semi-bright zinc electrodeposits.

EXAMPLE VI

An acid chloride-type zinc electroplating solution is prepared containing 35 g/l zinc ions, 210 g/l total chloride ions, 1 g/l of ethoxylated a-naphthol as a supporting carrier brightener, and 0.5 g/l of 3-sulfo-3-phenylpropanoic acid, mono sodium salt as the primary brightener. This primary brightener corresponds to the foregoing structural formulae in which X is OH, R is phenyl and Y is H. The electroplating solution is at a pH of about 5.0.

Parts plated in this solution at a cathode current density of about 40 ASF exhibited overall good brightness.

EXAMPLE VII

An acid chloride-type zinc electroplating solution is prepared containing 30 g/l zinc ions, 260 g/l total chloride ions, 30 g/l boric acid, 0.75 g/l Surfynol 485 (as defined in Example I) as a supporting carrier brightener and 0.05 g/l of 4-phenyl-4-sulfobuten-2-one, sodium salt.

Test panels plated in this solution at a temperature of about 75° F. in the presence of air agitation at a pH of 5.3 and a current density of 35 ASF exhibited substantially uniform brightness over the entire surface area thereof.

EXAMPLE VIII

An acid chloride-type zinc electroplating bath is prepared containing 35 g/l zinc ions, 300 g/l total chloride ions, 20 g/l boric acid, 0.5 g/l Surfynol 485 (as defined in Example I) as a supporting carrier brightener, 0.025 g/l of 4-phenyl-3-butyne-2-one, as a second supporting carrier brightener, and 0.03 g/l of a mixture of 4-phenyl-4-sulfobuten-2-one, sodium salt and 4-phenyl-4-disulfobutan-2-one, sodium salt. The electroplating solution was a pH of about 5.5.

Test panels plated in this solution at a current density of about 45 ASF under air agitation and at a bath temperature of about 75° F. exhibited very good clear color and brightness.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An aqueous zinc electroplating solution comprising zinc ions and an effective amount sufficient to provide a bright, adherent and ductile zinc electrodeposit on a conductive substrate of a bath soluble brightening agent comprising a compound and mixtures of compounds represented by the structural formulae:

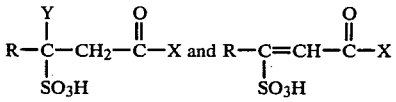

Wherein:

R is H or $C_6$–$C_{10}$ aryl, or $C_6$–$C_{20}$ alkyl aryl in which the alkyl group is $C_1$–$C_4$; or $C_1$–$C_{22}$ alkyl, or $C_2$–$C_{10}$ heterocyclic nitrogen compounds having at least one tertiary or quaternary ring containing nitrogen; as well as the mono, di or tri substituted derivatives thereof including —OH, —$SO_3H$ or —COOH; the Group I and II and $NH_4$ salts thereof; and the aldehyde, ketone and ether derivatives thereof;

X is R or —OR′ or —$NR_2$′ in which R′ is H or a $C_1$–$C_4$ aliphatic radical; and Y is H or $SO_3H$.

as well as the compatible bath soluble salts thereof.

2. The zinc electroplating solution as defined in claim 1 in which said brightening agent is present in an amount of about 0.001 to about 10 g/l.

3. The zinc electroplating solution as defined in claim 1 in which said brightening agent is present in an amount of about 0.01 to about 5 g/l.

4. The zinc electrotplating solution as defined in claim 1 in which said zinc ions are present in an amount of about 5 to about 110 g/l.

5. The zinc electroplating solution as defined in claim 1 comprising an acid chloride solution containing said zinc ions in an amount of about 7 to about 50 g/l and hydrogen ions to provide a pH of about 4.5 to about 6.2.

6. The zinc electroplating solution as defined in claim 5 further including about 20 to about 450 g/l of alkali metal chloride salts.

7. The zinc electroplating solution as defined in claim 1 comprising an acid sulfate solution containing said zinc ions in an amount of about 30 to about 110 g/l and hydrogen ions to provide a pH of about 3.5 to about 5.2.

8. The zinc electroplating solution as defined in claim 5 or 7 further including about 1 to about 40 g/l of boric acid as a buffering agent.

9. The zinc electroplating solution as defined in claim 1 comprising an alkaline solution containing said zinc ions in an amount of about 5 to about 25 g/l and an alkali metal hydroxide to provide a pH of about 12 to about 14.

10. The zinc electroplating solution as defined in claim 1 further including solution compatible secondary brightening agents in an amount up to about 10 g/l.

11. The zinc electroplating solution as defined in claim 10 in which said secondary brightening agents are present in an amount of about 0.2 to about 5 g/l.

12. A method for electrodepositing zinc on a substrate which comprises the step of electrodepositing zinc from an aqueous zinc electroplating solution as defined in claim 1 or 2 or 3 or 4 or 5 or 7 or 6 or 9 or 10 or 11.

13. A method for electrodepositing zinc on a substrate which comprises the step of electrodepositing zinc from an aqueous zinc electroplating solution as defined in claim 8.

* * * * *